US005293656A

United States Patent [19]

Chan

[11] Patent Number: 5,293,656

[45] Date of Patent: Mar. 15, 1994

[54] FOLDABLE FRAME ASSEMBLY FOR A CHILDREN'S PLAYPEN

[76] Inventor: Te-Erh Chan, 9th Fl., 49, Chung Ching S. Rd., Sec. 1, Taipei, 100, Taiwan

[21] Appl. No.: 994,633

[22] Filed: Dec. 21, 1992

[51] Int. Cl.[5] ..... A47D 13/06

[52] U.S. Cl. ..... 5/99.1; 5/98.1; 16/326; 16/325; 403/102

[58] Field of Search ..... 5/98.1, 98.3, 99.1; 16/321, 324–327, 335, 336; 403/92, 100, 102

[56] References Cited

U.S. PATENT DOCUMENTS 1,618,885 2/1927 Minor ..... 16/327 X
2,486,054 10/1949 Morse ..... 5/98.1 X
3,187,373 6/1965 Fisher ..... 403/102 X
4,226,549 10/1980 Batt ..... 403/92
4,811,437 3/1989 Dillner et al. ..... 5/99.1

*Primary Examiner*—Michael F. Trettel
*Attorney, Agent, or Firm*—W. Wayne Liauh

[57] ABSTRACT

A foldable frame assembly for a children's playpen, including an upper foldable rail mechanism composed of four upper rails each of which is foldable at a joint thereof, and a lower foldable rail mechanism composed of a chassis seat and four lower rails pivotally connected therewith in a radial pattern, wherein the upper rail mechanism is formed by simple components while the lower rail mechanism is provided with support-enhancing members to insure the safety in use.

1 Claim, 9 Drawing Sheets

FOLDABLE FRAME ASSEMBLY FOR A CHILDREN'S PLAYPEN

BACKGROUND OF THE INVENTION

Conventional foldable children's playpens include a foldable frame assembly. The folding portions of such foldable frame assembly are mostly disposed on the upper ends of peripheral walls and the chassis of the playpen. Foldable upper frame assemblies of children's playpens are disclosed in U.S. Pat. Nos. 4,357,735; 4,070,716; 4,044,411; 4,573,224; 4,376,318; 4,069,524; 4,811,437; etc. Foldable chassis frame assemblies of children's playpens are disclosed in U.S. Pat. Nos. 4,703,505; 4,538,309; 4,008,499; 4,688,280; 4,811,437, etc.

In the above-mentioned U.S. Pat. Nos. 4,811,437 includes both the foldable upper and lower assemblies. However, two drawbacks exist in this U.S. Pat. No. 4,811,437 as follows:

1. The folding mechanism of the upper frame assembly thereof includes multiple components such that the assembling procedure is complicated and the manufacturing cost is high.

2. The folding mechanism of the chassis includes six support legs diverging radially outwardly. However, four inner panels of the children's playpen are connected and two L-shaped connectors of a middle transverse rail of the chassis are located at the central connecting portions between the inner panels. Consequently, no appropriate supporting force can be provided and safety cannot be insured.

SUMMARY OF THE INVENTION

It is a primary object of the present invention to provide a foldable upper frame assembly for a children's playpen of the foldable type, wherein a guide block is used to control a resilient member for locking and unlocking the foldable frame assembly. When the resilient member unlocks the foldable frame assembly, the same can be folded and collapsed.

It is a further object of the present invention to provide a foldable, supporting chassis frame assembly for a children's playpen of the foldable type, wherein four lower rails are pivotally connected with a chassis seat in a radial pattern and two L-shaped supporting members are pivotally connected with two opposite lower rails for supporting the bottom panels of a children's playpen.

DETAILED DESCRIPTION OF THE PREFERRED EMBODIMENTS

Figure 1:
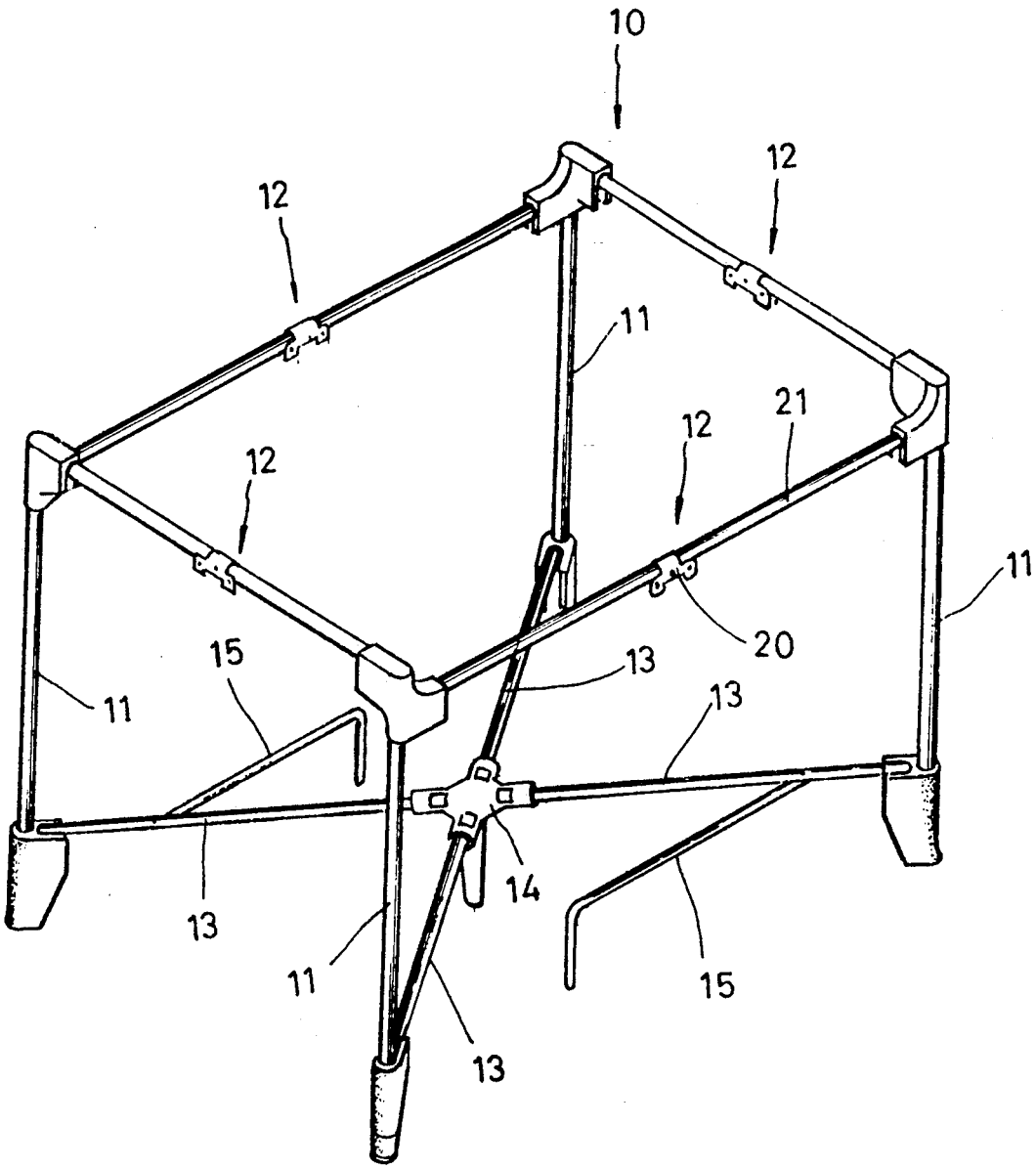
FIG. 1 a perspective view of the foldable frame assembly of the invention in a spread configuration.
Figure 2:
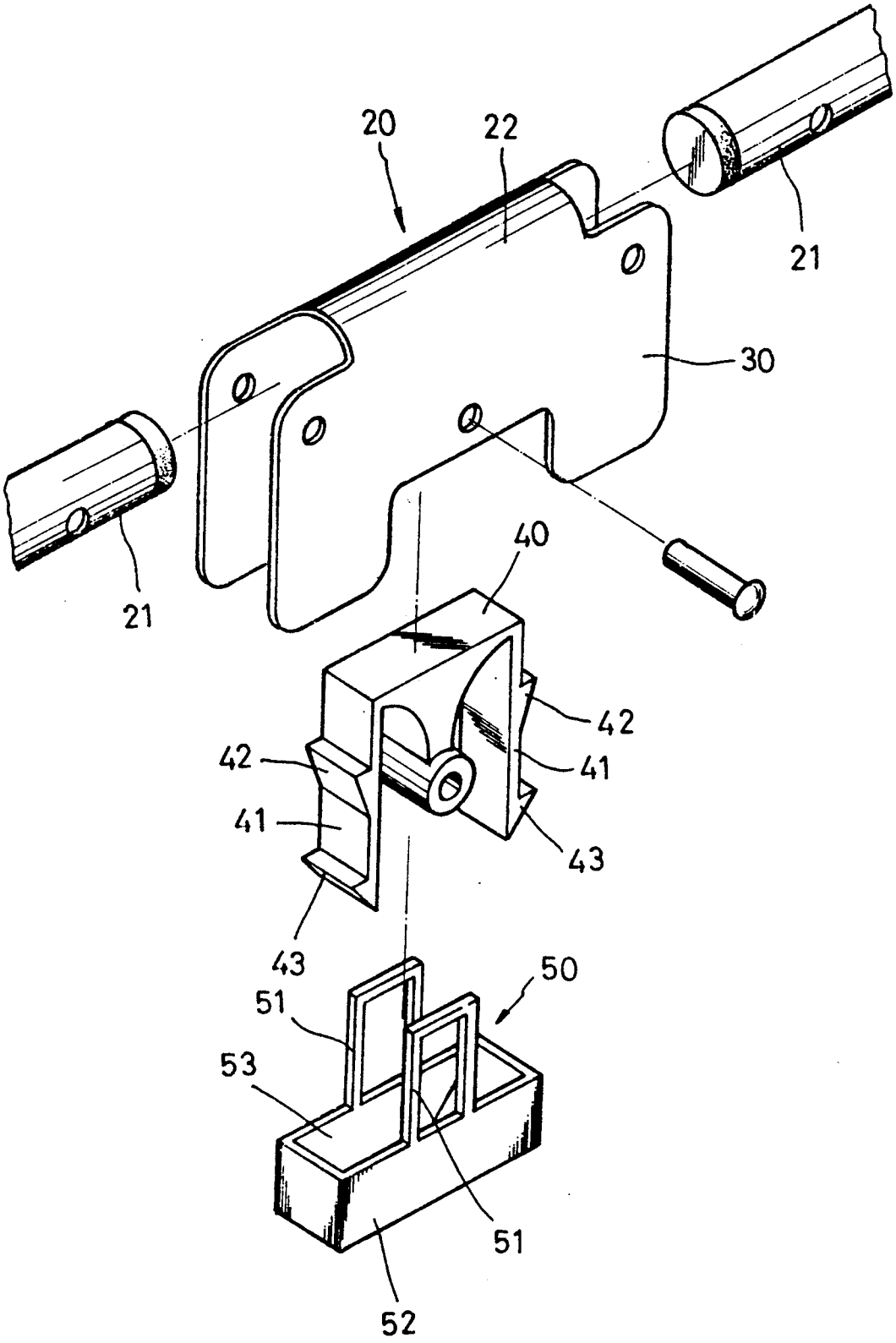
FIG. 2. an exploded perspective view of the joint of the upper rail.

Please refer to FIGS. 1 and 2. The present frame assembly 10 of the foldable children's playpen includes four leg supports 11, four upper rails 12 pivotally connected with the leg supports 11, four lower rails 13 pivotally connected with a chassis seat 14 in a radial pattern, and two L-shaped members 15 pivotally connected with two opposite lower rails 13.

Two ends of each upper rail 12 are pivoted to two leg supports 11. One end of each lower rail 13 is pivoted to the lower portion of one leg support 11 while the other end thereof is pivoted to the chassis seat 14.

The upper rail 12 is formed by two circular tubes 21 and a foldable joint 20. The foldable joint 20 pivotally connects the inner ends of two circular tubes 21, including a cover 30, a resilient member 40 and a guide block 50. The resilient member 40 is secured in the cover 30, having two biasable plates 41 on its two sides. The biasable plate 41 is formed with a middle projection 42 and a lower projection 43 each of which has a lower slanted face. The guide block 50 has an upper U-shaped section 51 suitable to be hung inside the cover 30 and move up and down therewithin. The guide block 50 further has a lower block 52 formed as a triangular recess 53 having two slanted walls. The upper edges of the recess 53 abut against the slant faces of the projections 43 of the biasable plates 41 of the resilient member 40, while the inner ends of two neighboring circular tubes 21 pivotally connect with two sides of the cover 30.

Figure 3:
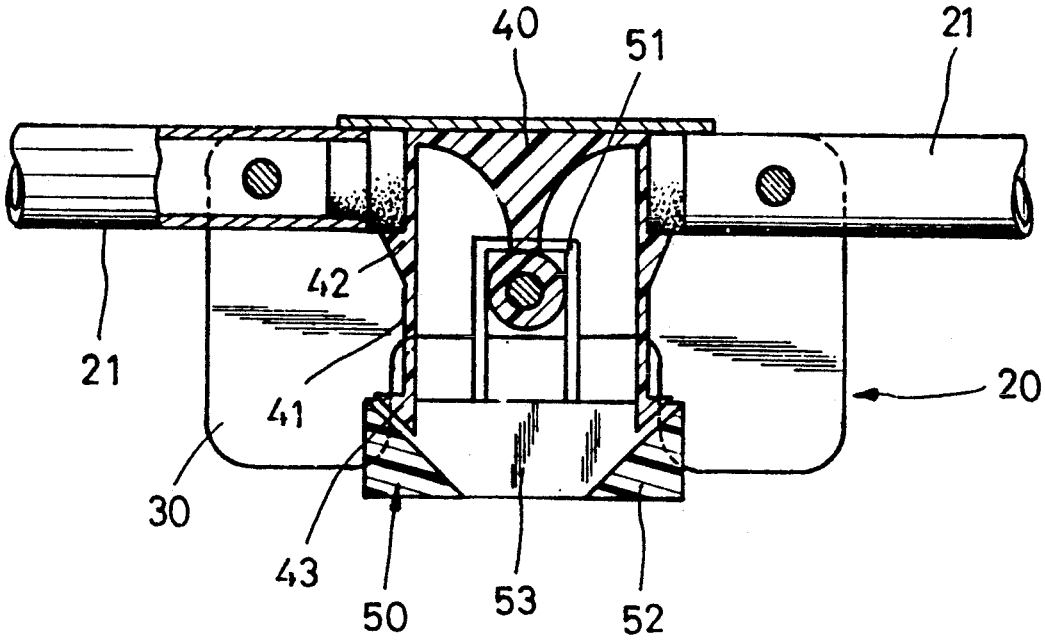
FIG. 3 an assembled sectional view of the joint and the upper rail in a locked state.
Figure 4:
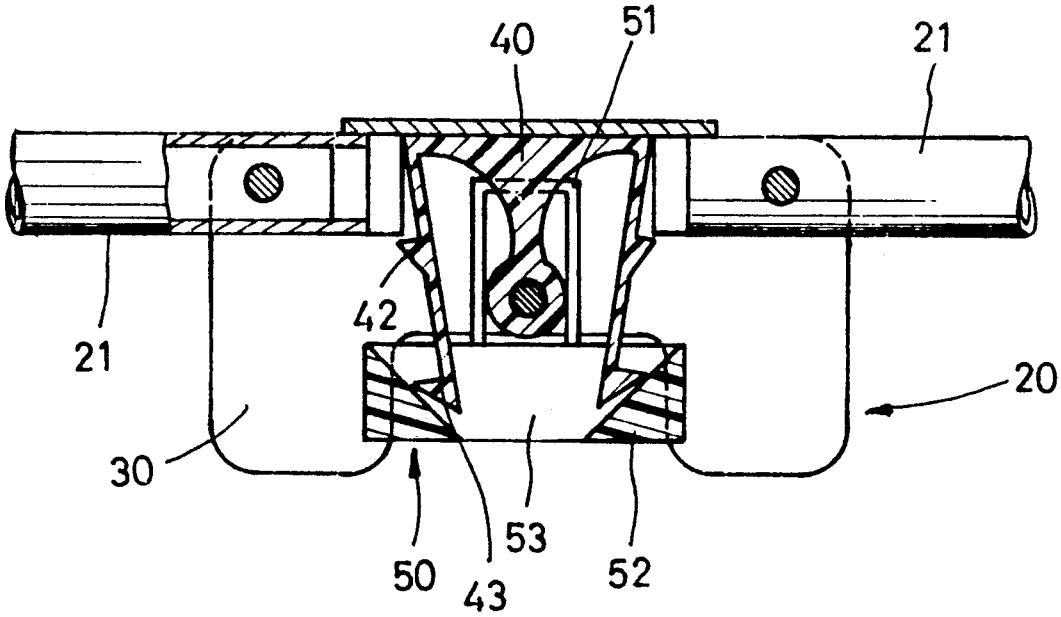
FIG. 4 is a view according to FIG. 3, showing the joint and the upper rail in an unlocked state.
Figure 5:
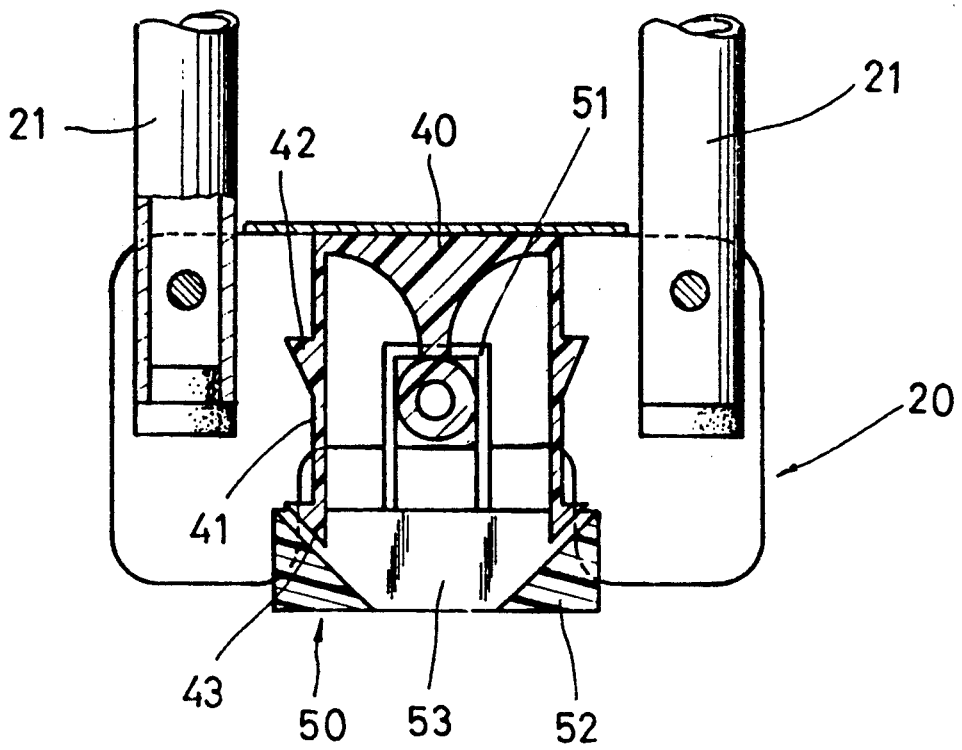
FIG. 5 a view to FIG. 4, showing that the upper rail is pivoted upward.

Please now refer to FIG. 3. In a spread configuration, the tubes 21 are restricted from moving by the projections 42 of the biasable plates 41, forming a straight and upstanding pattern. When the guide block 50 is pushed upward, the slanted walls of the triangular recess 53 thereof will force the projections 43 and inward bias the biasable plates 41. At this point, the projections 42 of the biasable plates 41 release the lower edges of the tubes 21 as shown in FIG. 4 so that the cover 30 can be pressed down to downwardly fold the upper rail 12 at the joint 20 as shown in FIG. 5.

Figure 7:
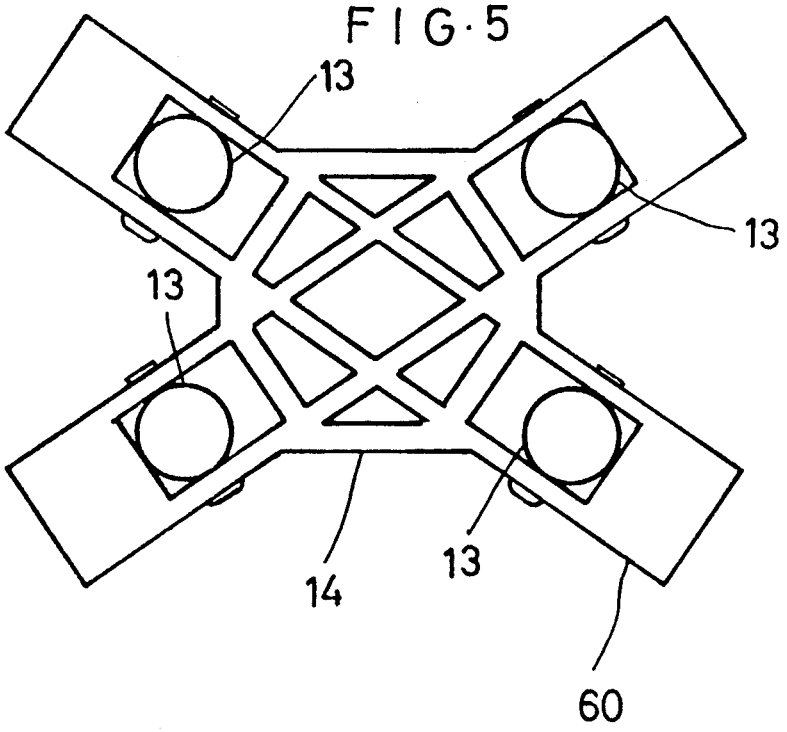
FIGS. 6 and 7 show the chassis seat and the lower rails pivotal connected thereto.
Figure 6:
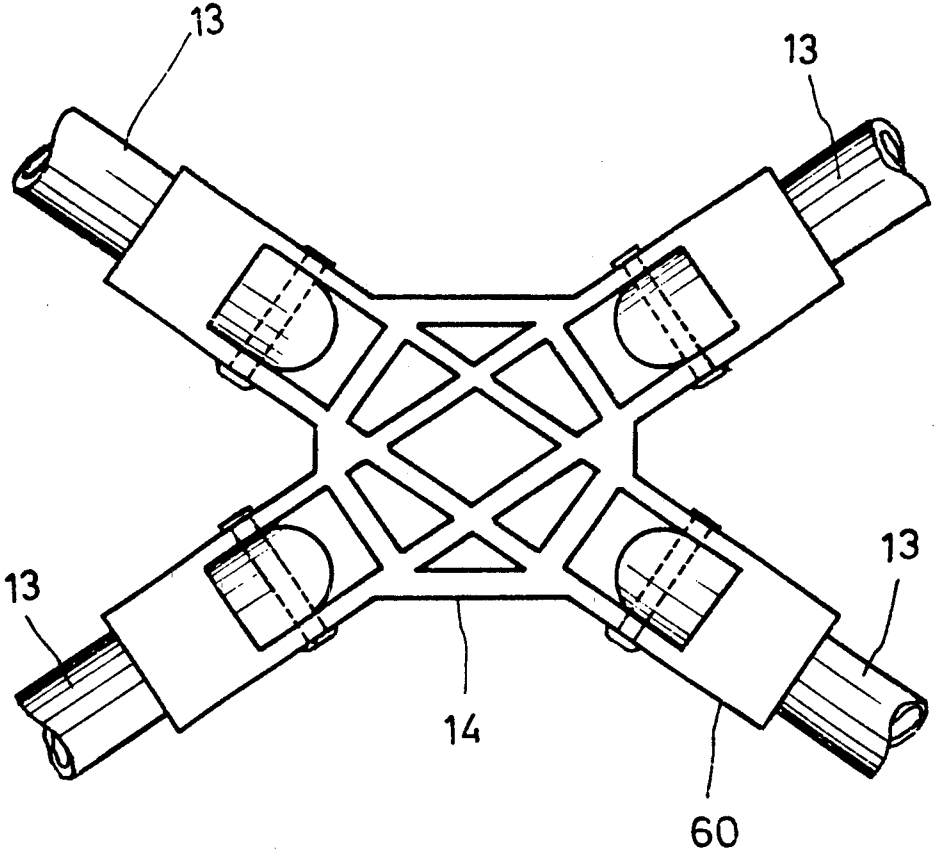

Please now refer to FIGS. 6 and 7. One end of each lower rail 13 is pivotally connected with the chassis seat 14 in a radial pattern. The other end thereof is pivotally connected under the leg support 11. The chassis seat 14 is formed with four downward facing grooves 60 each of which pivotally connects with and supports one lower rail 13.

Figure 8:
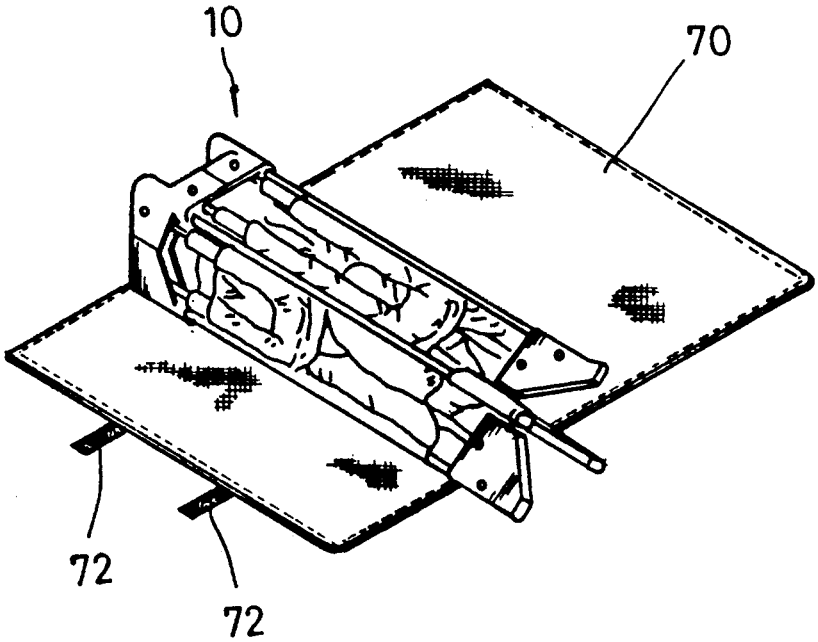
FIG. 8 shows the folded children's playpen.

FIG. 6 shows a spread configuration of the chassis. When the chassis seat 14 is pulled upward, the chassis is folded as shown in FIG. 8.

Figure 9:
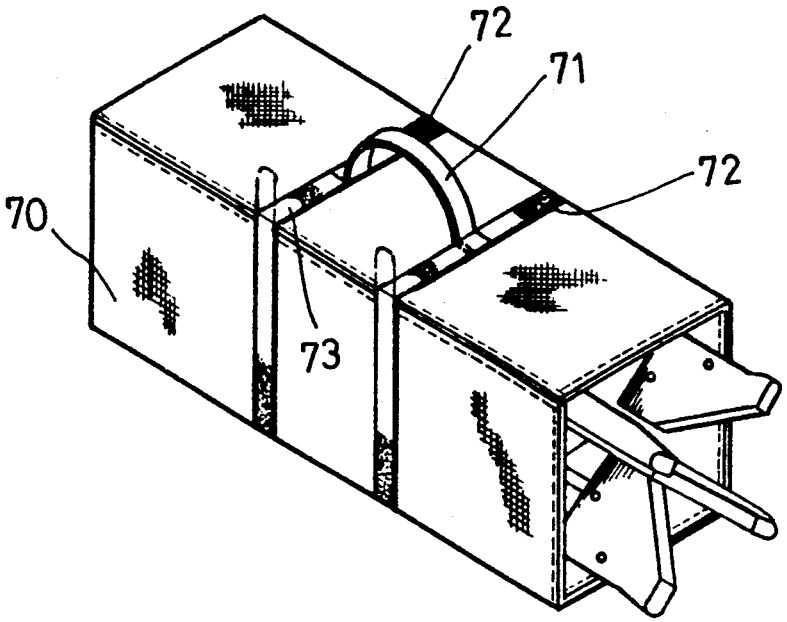
FIG. 9 according to FIG. 8, in which the folded children's playpen is wrapped by the panels.
Figure 10:
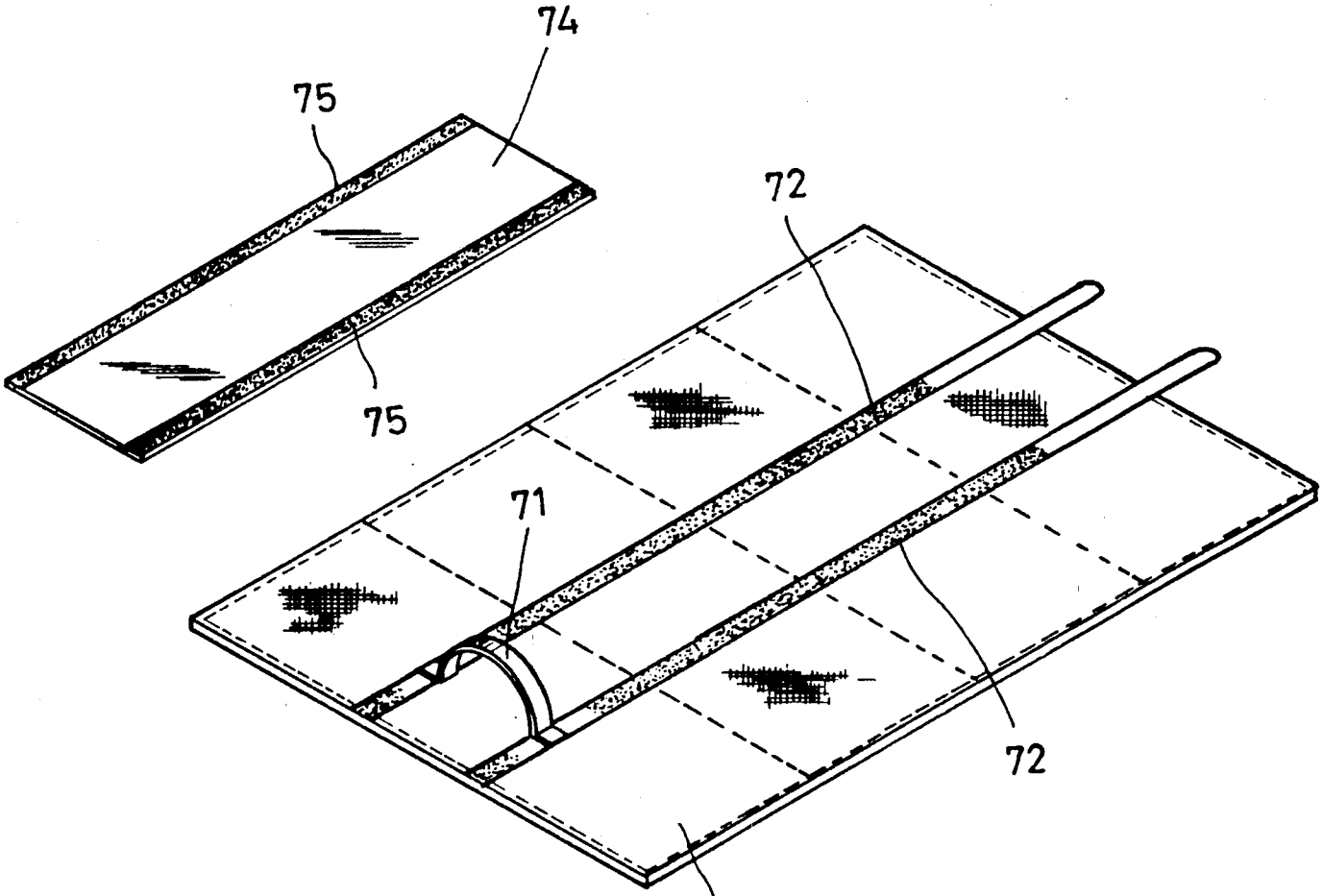
FIG. 10 shows the panel with the fluff strips.

According to the above arrangement, the children's playpen can be folded into a state as shown in FIG. 9. The folded playpen can be further wrapped and secured by four associated panels 70 into a state as shown in FIG. 10. The panel 70 is disposed with a handle 71, two fluff strips 72 and corresponding hook strips 73, whereby after the children's playpen is wrapped, the panels 70 can be fixed by means of attaching the hook strips 73 to the fluff strips 72. When the panels 70 are stretched for use, the fluff strips 72 can be attached to hook strips 75 of a pane 74 for enhancing the strength of the panels 70.

Figure 11:
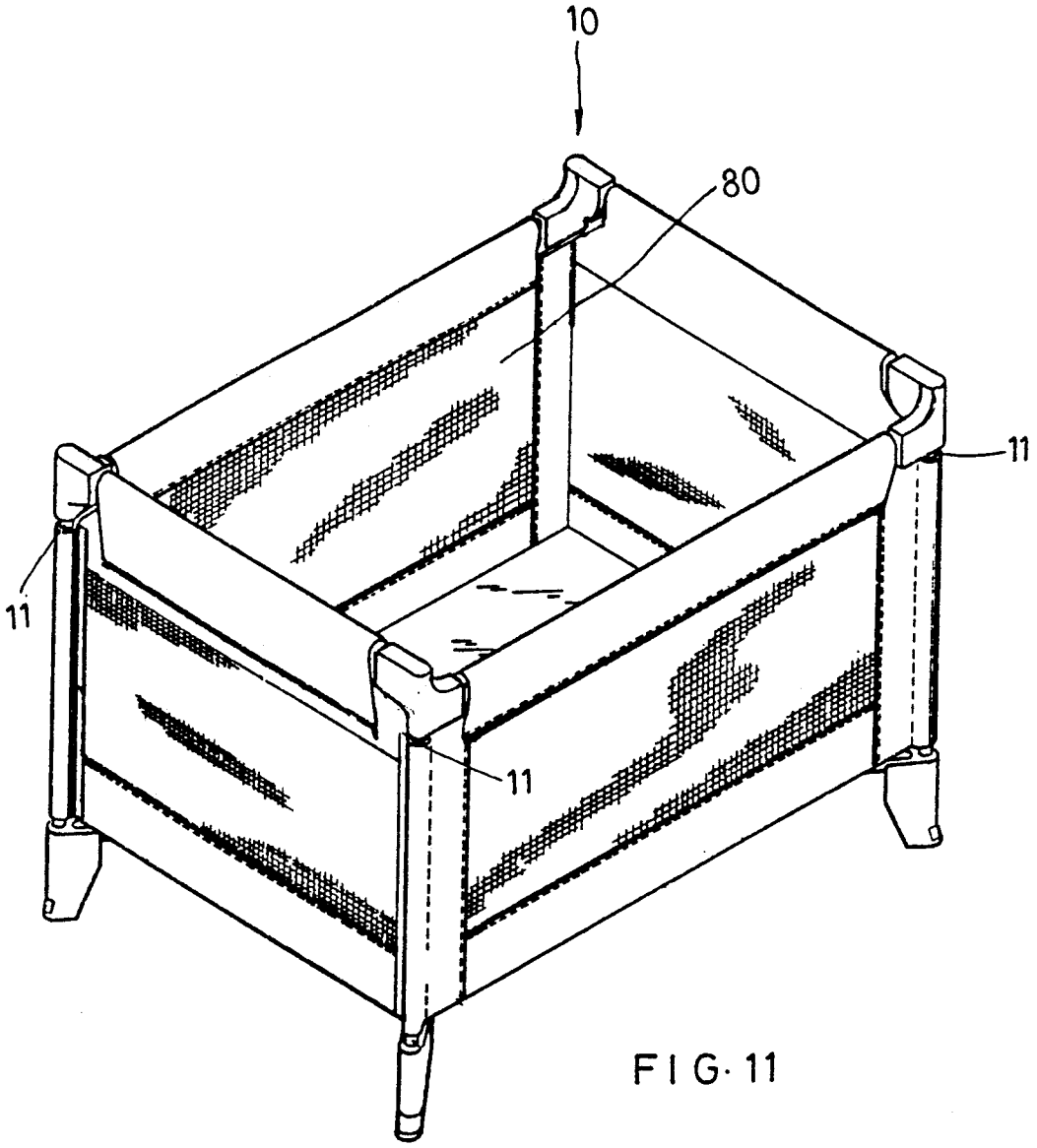
FIG. 11 shows the spread and upstanding children's playpen.
Figure 12:
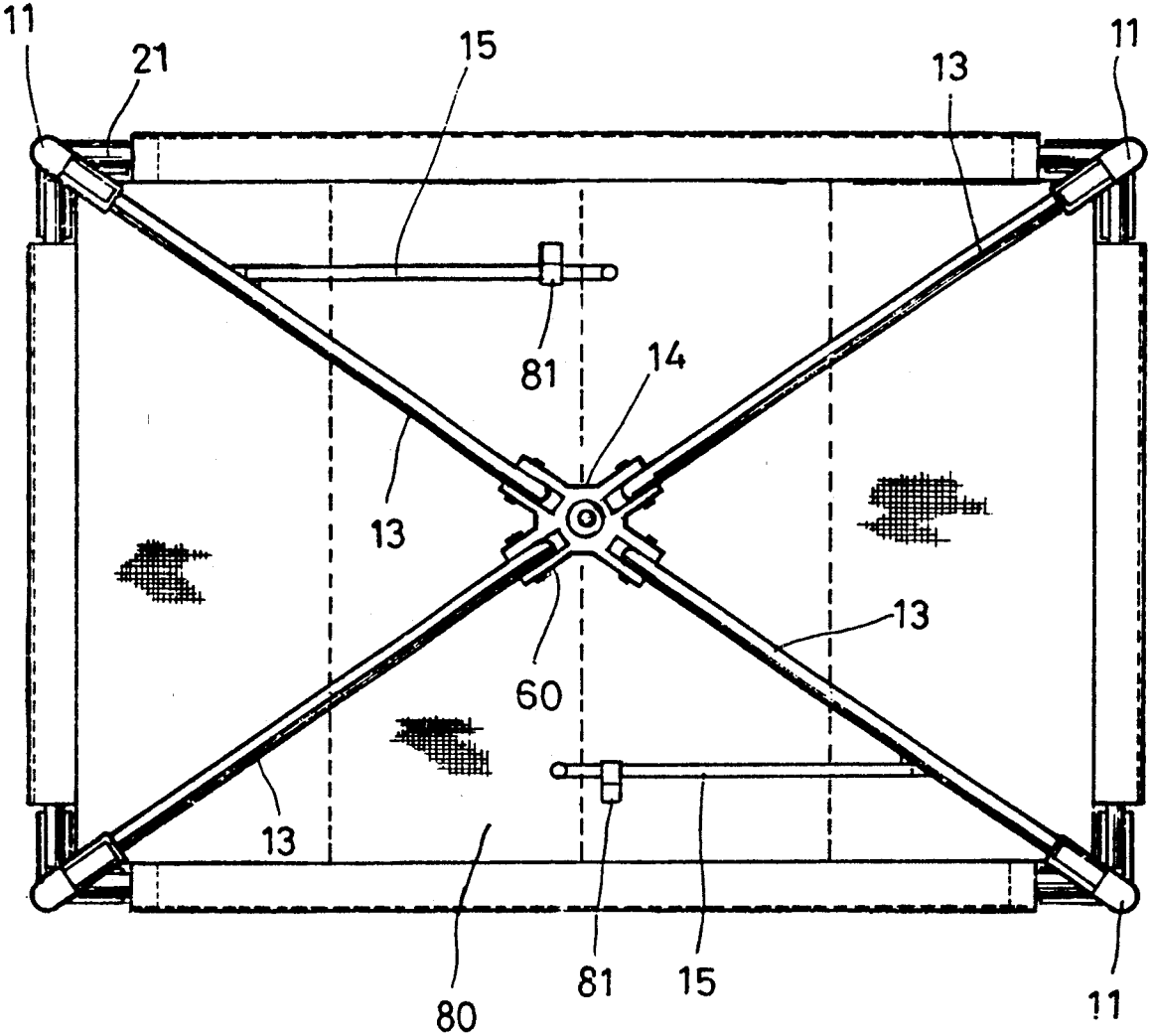
FIG. 12 is a bottom view of the chassis of the children's playpen.

Please now refer to FIGS. 11 and 12. The children's playpen of the present invention is fitted with a fabric 80 under which two fasteners 81 are disposed for holding the L-shaped members 15, so that the same can properly support the panels 70 at the front and rear edge thereof. When the children's playpen is folded, the fabric 80 can be pulled upward and collapse the L-shaped members 15.

The above foldable mechanism of the present invention includes less components so that the assembly and operation thereof are easy. Therefore, the manufacturing cost is reduced. In addition, the L-shaped members 15 can enhance the supporting effect to ensure the safety in use.

What is claimed is:

1. A foldable frame assembly for a children's playpen, comprising four leg supports four upper rails pivotally connected with said leg supports, a chassis seat, four lower rails the inner ends of which are pivotally connected with said chassis seat in a radial pattern, and two L-shaped members pivotally connected with two opposite lower rails, wherein said chassis seat is disposed at the center of the bottom of said frame assembly and the outer ends of said lower rails connect with the lower portions of said leg supports, each of said four upper rails being composed of two tubes having inner ends and outer ends and a foldable joint connecting said two tubes at the inner ends thereof, said frame assembly being characterized in that said foldable joint is formed by a cover having two ends a resilient member and a guide block, wherein said resilient member is secured in said cover, having two biasable plates on two sides, each of said biasable plates being formed with a middle projection and a lower projection both of which have lower slated faces, said guide block having an upper U-shaped section suitable to be hung inside said cover and move up and down therewithin and a lower block section formed with a triangular recess having two slanted walls, the upper edges of said slanted walls of said lower block section abutting against said lower slanted faces of said lower projections of said biasable plates of said resilient member, the inner ends of each of said two tubes pivotally connected with each of said two sides of said cover respectively, lower edges of said tubes being restricted in pivotal movement by said middle projections of said biasable plates to keep said upper rails in a straight configuration, said guide block being upward pushable such that said slanted walls of said triangular recess thereof moving said lower projections of said biasable plates and inwardly bias the same in order to release said lower edges of said tubes from restriction of said middle projections of said biasable plates and thus permit said upper rails to be downward folded at said pivots thereof.

* * * * *